US011614058B1

(12) United States Patent
Yang et al.

(10) Patent No.: US 11,614,058 B1
(45) Date of Patent: Mar. 28, 2023

(54) INTAKE SYSTEM OF VEHICLE

(71) Applicants: Hyundai Motor Company, Seoul (KR); Kia Corporation, Seoul (KR)

(72) Inventors: Sung Min Yang, Incheon (KR); Seung Yun Kwak, Suwon-Si (KR); Won Seop Choi, Anyang-Si (KR); Tae Yeong Won, Suwon-Si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/869,492

(22) Filed: Jul. 20, 2022

(30) Foreign Application Priority Data

Dec. 14, 2021 (KR) ..... 10-2021-0179026

(51) Int. Cl.

| | |
|---|---|
| ***F02M 35/10*** | (2006.01) |
| ***F02M 35/14*** | (2006.01) |
| ***F02M 35/12*** | (2006.01) |
| ***F02M 35/02*** | (2006.01) |
| *F02M 35/024* | (2006.01) |
| *F02M 35/022* | (2006.01) |

(52) U.S. Cl.
CPC ..... *F02M 35/14* (2013.01); *F02M 35/0216* (2013.01); *F02M 35/1266* (2013.01); *F02M 35/024* (2013.01); *F02M 35/0226* (2013.01)

(58) Field of Classification Search
CPC .. F02M 35/024; F02M 35/1261; F02M 35/14; F02M 35/02416; B01D 2279/60; B01D 46/0005
USPC ..... 123/184.57
See application file for complete search history.

(56) References Cited

U.S. PATENT DOCUMENTS

| | | | | |
|---|---|---|---|---|
| 6,530,984 | B2 * | 3/2003 | Stuart | F02M 35/1261 96/380 |
| 10,006,416 | B2 * | 6/2018 | Aydin | F02M 35/10386 |
| 2005/0268582 | A1 * | 12/2005 | Su | B01D 46/0031 55/385.3 |
| 2009/0293832 | A1 * | 12/2009 | Matsumoto | F02M 35/1283 123/184.61 |
| 2012/0073539 | A1 * | 3/2012 | Lee | F02M 35/14 123/198 E |
| 2017/0138322 | A1 * | 5/2017 | Cho | F02M 35/0218 |
| 2019/0186447 | A1 * | 6/2019 | Kwak | F02M 35/1216 |

FOREIGN PATENT DOCUMENTS

| | | |
|---|---|---|
| KR | 10-2001-0047717 | 6/2001 |
| KR | 10-2009-0065379 | 6/2009 |
| KR | 10-2019-0139494 | 12/2019 |

* cited by examiner

*Primary Examiner* — Long T Tran
*Assistant Examiner* — James J Kim
(74) *Attorney, Agent, or Firm* — Morgan, Lewis & Bockius LLP

(57) ABSTRACT

An intake system of a vehicle is configured so that air moves along a 'U'-shaped movement path from an entrance of an intake duct portion into which outside air is introduced to a position where a filter is mounted, and is configured so that the intake duct portion, an air cleaner body portion, and an external resonator are formed integrally with each other.

16 Claims, 10 Drawing Sheets

500
520
150
400
110
300
100
ENGINE
120
180
600
620
700

400
M1
111
200
110
170
100
150
120
620
600
800
130
700
710

500
510
520

INTAKE SYSTEM OF VEHICLE

CROSS REFERENCE TO RELATED APPLICATION

The present application claims priority to Korean Patent Application No. 10-2021-0179026, filed Dec. 14, 2021, the entire contents of which is incorporated herein for all purposes by this reference.

BACKGROUND OF THE INVENTION

Field of the Present Disclosure

The present disclosure relates to an intake system of a vehicle. More particularly, the present disclosure relates to an intake system of a vehicle, the intake system being capable of maximally preventing moisture and foreign substances from entering an air cleaner, and being capable of realizing a simplified configuration by having an integrated-type structure.

Description of Related Art

An intake system of a vehicle is a system configured to supply fresh air (clean air), which is outside air having foreign substances removed therefrom, to a combustion chamber of an engine, and includes an intake duct (air duct), an air cleaner, and an intake hose (air hose).

When moisture (water) is introduced into the air cleaner of the intake system, a situation in which not only damage to the intake system occurs but also damage to the engine occurs in a severe situation occurs. Therefore, to prevent the present situation, a new type of an intake system layout structure is required.

In Southeast Asia, which is a tropical rain forest region, the average annual amount of precipitation is larger than that of other regions, so that a situation in which vehicles are fording on rivers, streams, and the like is frequently occurs. At the instant time, to secure fording ability of a vehicle, a situation in which moisture (water) is introduced into an air cleaner is required to be maximally prevented. Therefore, a new type of an intake system layout structure capable of preventing introduction of moisture is required.

Furthermore, a conventional intake system is configured so that an intake duct, an air cleaner, and an intake hose are individually formed and then are connected to and coupled to each other, which has disadvantages of causing an increase in man-hours and an increase in manufacturing cost.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present disclosure are directed to providing an intake system of a vehicle, the intake system being configured for maximally preventing moisture and foreign substances from being introduced into an air cleaner, and the intake system being configured for increasing fording ability of the vehicle when the intake system is used especially in a tropical rain forest region, such as Southeast Asia, including a large amount of precipitation.

Furthermore, various aspects of the present disclosure are to provide an intake system of a vehicle, the intake system being configured in a structure in which an intake duct and an air cleaner are formed integrally with each other or being configured in a structure in which the intake duct, the air cleaner, and an external resonator are formed integrally with each other, realizing a simplified configuration, and a reduction in man-hours and in manufacturing cost.

To achieve the objective of the present disclosure, there is provided an intake system of a vehicle, the intake system including: an air cleaner body assembly in which an intake duct portion into which air moves and an air cleaner body portion where a filter is mounted are formed integrally with each other; and an air cleaner cover which is detachably coupled to the air cleaner body portion and to which an intake hose is connected.

Furthermore, an entrance of the intake duct portion and the filter which is mounted in the air cleaner body portion may be positioned above a connection portion that connects the intake duct portion and the air cleaner body portion, so that an air movement path from the entrance of the intake duct portion to the filter is formed along an arcuate route.

Furthermore, the air movement path from the entrance of the intake duct portion to the filter may be formed in a shape of "U".

Furthermore, the intake system may further include an intake shield which is coupled to an entrance of the intake duct portion and which is preventing moisture and impurities from being introduced into the intake duct portion, wherein the intake shield may include a casing portion coupled to the intake duct portion, and may include a grill portion provided in a front surface of the casing portion.

Furthermore, the intake duct portion may be provided with a first internal resonator portion that is formed to expand a space thereof by being connected to the intake duct portion.

Furthermore, the air cleaner body portion may be provided with a second internal resonator portion which is for reducing noise, and a filter mounting portion may be provided above the second internal resonator portion.

Furthermore, an air cleaner body lower cap may be fusion-coupled to a lower end portion of the air cleaner body portion, and a first drain valve for discharging moisture and impurities may be provided at a bottom portion of the air cleaner body lower cap.

Furthermore, the air that has been introduced into the intake duct portion may move downward along the intake duct portion, and then may pass through the filter after passing through the air cleaner body lower cap and the second internal resonator portion.

Furthermore, the intake system may further include a plurality of connection holes that fluidically connects the intake duct portion and the air cleaner body portion from above the air cleaner body lower cap, wherein when water flows backward to the air cleaner body lower cap through the first drain valve, the air that has been introduced into the intake duct portion may move downward along the intake duct portion and then may move to the air cleaner body portion through the plurality of connection holes, and then may pass through the filter by bypassing the second internal resonator portion.

Furthermore, the intake system may further include an external resonator which is connected to the air cleaner body lower cap and which reduces engine noise.

Furthermore, the external resonator may be manufactured as an individual component, and may be coupled to the air cleaner body lower cap.

Furthermore, the external resonator may be formed integrally with the air cleaner body lower cap.

Furthermore, when the external resonator is manufactured as an individual component and is coupled to the air cleaner body lower cap, a rubber seal may be coupled to a portion to which the air cleaner body lower cap and the external resonator are coupled so that airtightness is maintained therebetween.

Furthermore, a second drain valve for discharging the moisture and the impurities may be provided at a bottom portion of the external resonator.

Furthermore, a diffuser connected to the intake hose may be formed integrally with the air cleaner cover.

Furthermore, on the air cleaner cover, a third internal resonator may be integrally provided on an upper end portion of the diffuser, and a resonator cap may be fusion-coupled to the air cleaner cover to form a volume of the third internal resonator.

According to an exemplary embodiment of the present disclosure, the intake system of the vehicle is configured so that air moves along the 'U'-shaped movement path from the entrance of the intake duct portion into which outside air is introduced to a position where the filter is mounted. Therefore, even if moisture (water) is introduced into the intake duct portion together with outside air, water that has been introduced into the intake duct portion is prevented from moving to the filter of the air cleaner body portion, so that there is an effect that damage to the intake system by water and also damage to the engine may be maximally prevented.

Furthermore, according to an exemplary embodiment of the present disclosure, the intake system of the vehicle is configured so that the intake duct portion into which outside air is introduced, the air cleaner body portion in which the filter is mounted are formed integrally with each other. Furthermore, as necessary, the external resonator is formed integrally with the air cleaner body portion, so that there is an effect that a simplified configuration may be realized and reduction in man-hours and in manufacturing cost may be realized.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
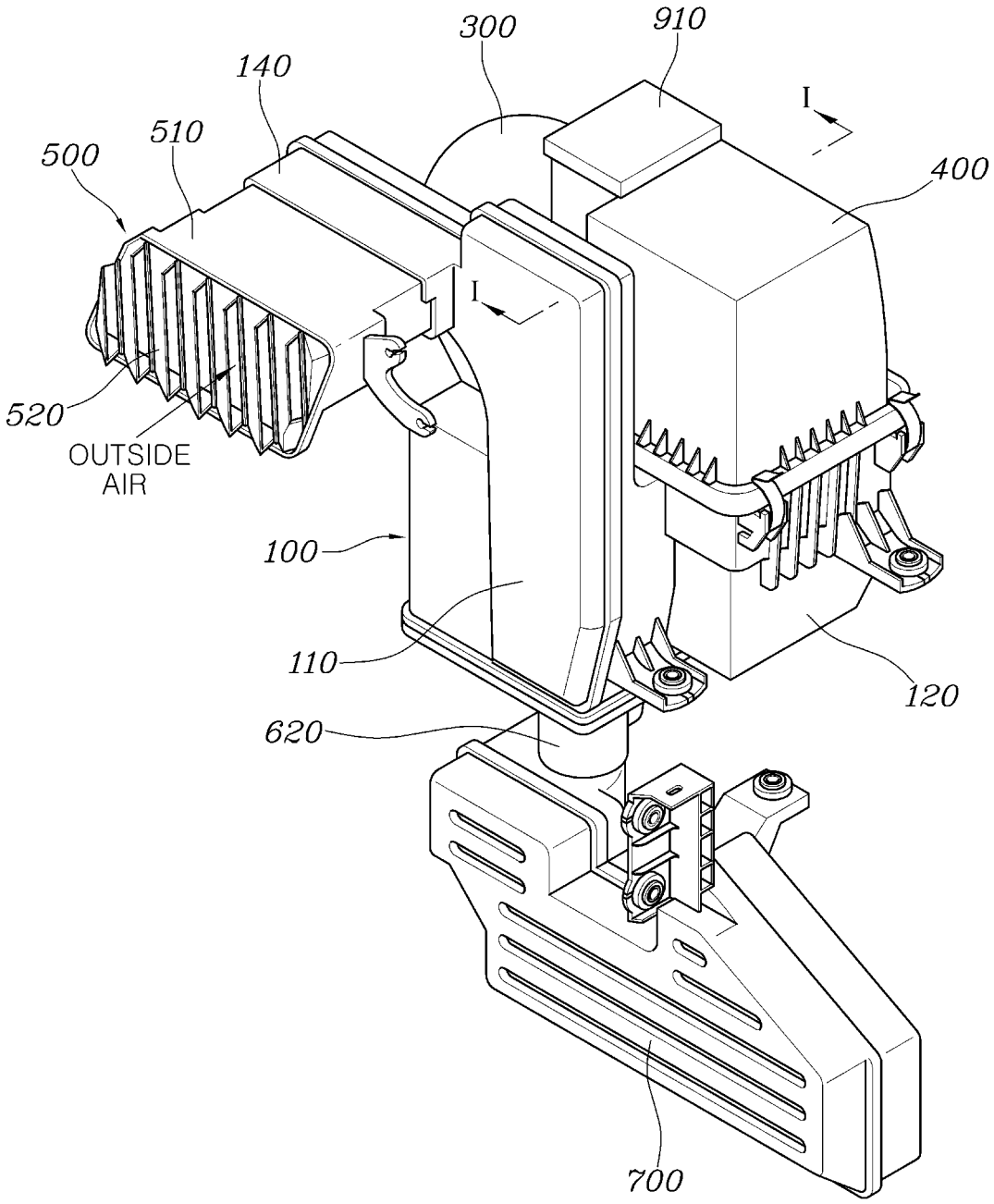
FIG. 1 is a perspective view exemplarily illustrating an intake system according to an exemplary embodiment of the present disclosure.
Figure 2:
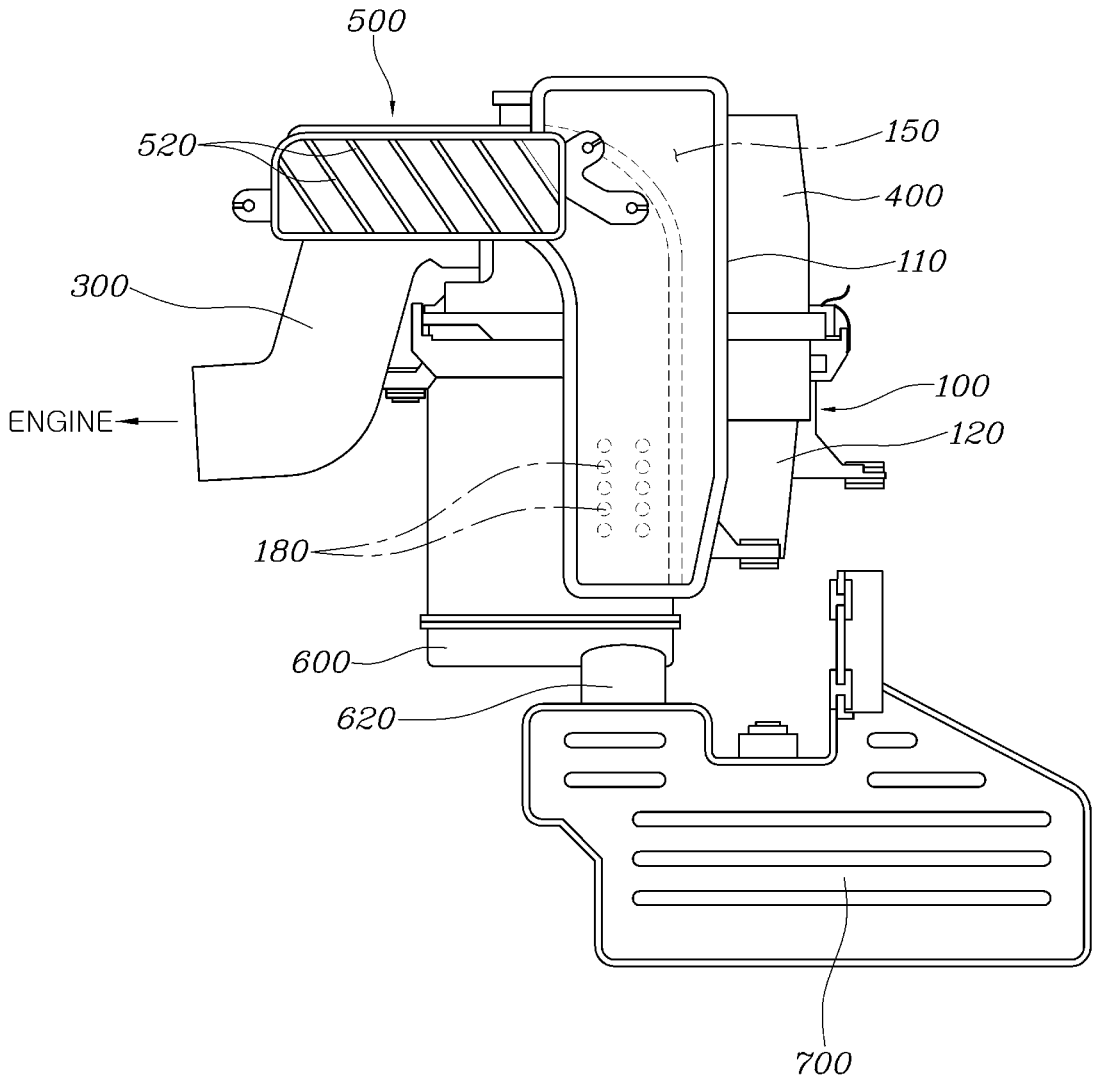
FIG. 2 is a left side view of FIG. 1.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

In the following description, the structural or functional description specified to exemplary embodiments according to the concept of the present disclosure is directed to describe the exemplary embodiments of the present disclosure, so it should be understood that the present disclosure may be variously embodied, without being limited to the exemplary embodiments of the present disclosure.

Embodiments described herein may be changed in various ways and various shapes, so specific embodiments are shown in the drawings and will be described in detail in the exemplary embodiment of the present disclosure. However, it should be understood that the exemplary embodiments according to the concept of the present disclosure are not limited to the exemplary embodiments which will be described hereinbelow with reference to the accompanying drawings, but all of modifications, equivalents, and substitutions are included in the scope and spirit of the present disclosure.

It will be understood that although the terms first and/or second, etc. may be used herein to describe various elements, these elements should not be limited by these terms. The above terms are only for distinguishing one component from other components, for example, without departing from the scope of the rights according to the concept of the present disclosure, the first component may be referred to as the second component, and similarly the second component may also be referred to as a first component.

When a component is referred to as being "connected" or "contacted" to another component, it should be understood that it may be directly connected or contacted to the other component, but other components may exist therebetween. On the other hand, when a component is referred to as being "directly connected" or "directly contacted" to another component, it should be understood that there is no other component therebetween. Other expressions describing the relationship between components, such as "between" and "just between" or "adjacent to" and "directly adjacent to" may be construed similarly.

The terminology used herein is for the purpose of describing various exemplary embodiments only and is not intended to limit the present disclosure. Singular expressions include plural expressions unless the context clearly indicates otherwise. It will be further understood that the terms "comprises" or "have" used in the exemplary embodiment, specify the presence of stated features, steps, operations, components, parts, or a combination thereof, but do not preclude the presence or addition of one or more other features, numerals, steps, operations, components, parts, or a combination thereof.

Unless otherwise defined, all terms used herein, including technical or scientific terms, have the same meaning as commonly understood by one of ordinary skill in the art to which an exemplary embodiment of the present disclosure belongs. Terms such as those defined in a commonly used dictionary should be interpreted as having a meaning consistent with the meaning of the related technology, and should not be interpreted as an ideal or excessively formal meaning unless explicitly defined in the exemplary embodiment of the present disclosure.

In various exemplary embodiments of the present disclosure, the controller may be realized by a non-volatile memory configured to store an algorithm for controlling the operation of various elements of a vehicle or data on software commands for executing the algorithm and a processor configured to perform an operation, which will be described below, using the data stored in the memory. Here, the memory and the processor may be realized as individual chips. Alternatively, the memory and the processor may be realized as a single integrated chip. The processor may include one or more processors.

Hereinafter, an intake system of a vehicle according to various exemplary embodiments of the present disclosure will be described with reference to the accompanying drawings.

As illustrated in FIGS. 1 to 10, an intake system of a vehicle according to various exemplary embodiments of the present disclosure may include an air cleaner body assembly 100 in which an intake duct portion 110 intaking outside air that includes impurities, and an air cleaner body portion 120 in which a filter 200 is mounted are formed integrally with each other; and an air cleaner cover 400 which is detachably coupled to the air cleaner body portion 120 and to which an intake hose 300 is connected.

The intake duct portion 110 is a configuration corresponding to an intake duct (an air duct) in a conventional intake system, and the air cleaner body portion 120 is a configuration corresponding to a conventional air cleaner body. Conventionally, the intake duct in the conventional intake system and the conventional air cleaner body are each formed individually and are coupled to each other. However, according to an exemplary embodiment of the present disclosure, the intake duct portion 110 and the air cleaner body portion 120 are formed integrally with each other, so that a simplified configuration may be realized and reduction in man-hours and in manufacturing cost may be realized.

Figure 3:
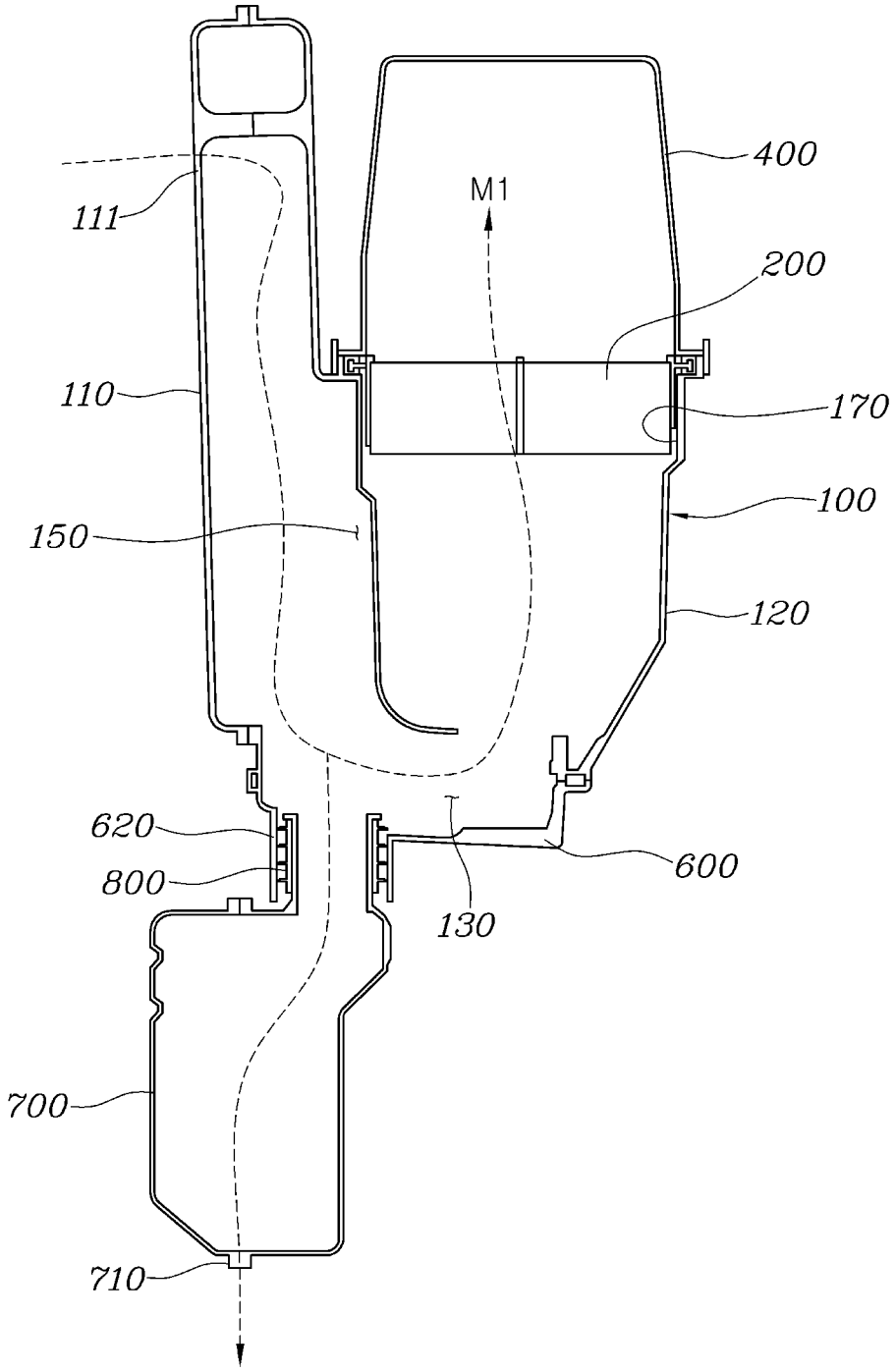
FIG. 3 is a cross-sectional view taken along line I-I in FIG. 1.
Figure 4:
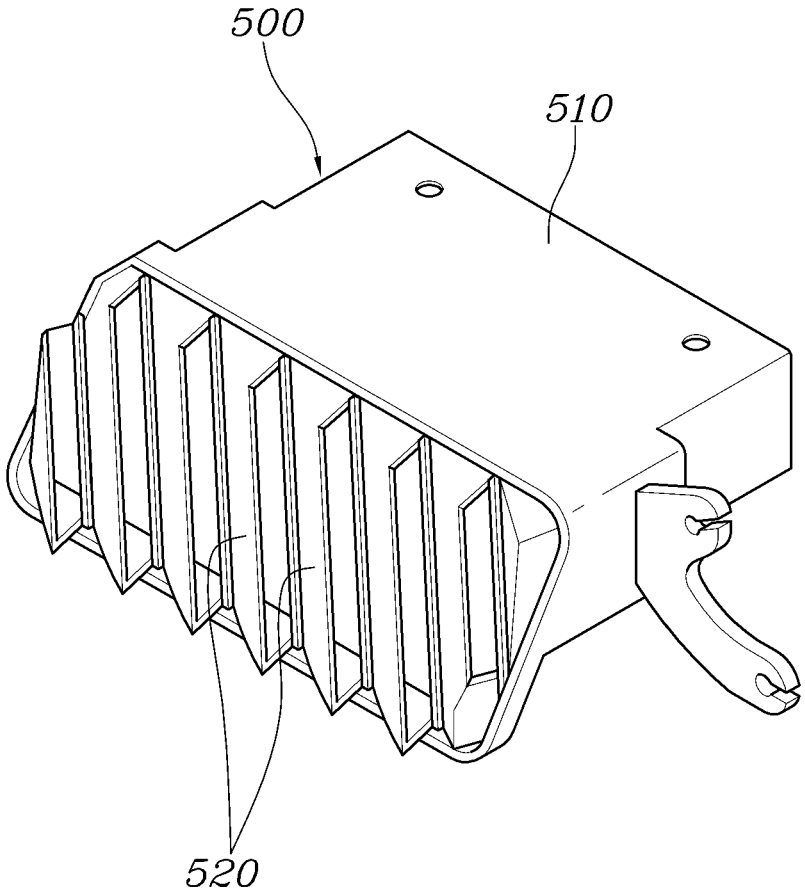
FIG. 4 is a perspective view exemplarily illustrating an intake shield according to an exemplary embodiment of the present disclosure.
Figure 5:
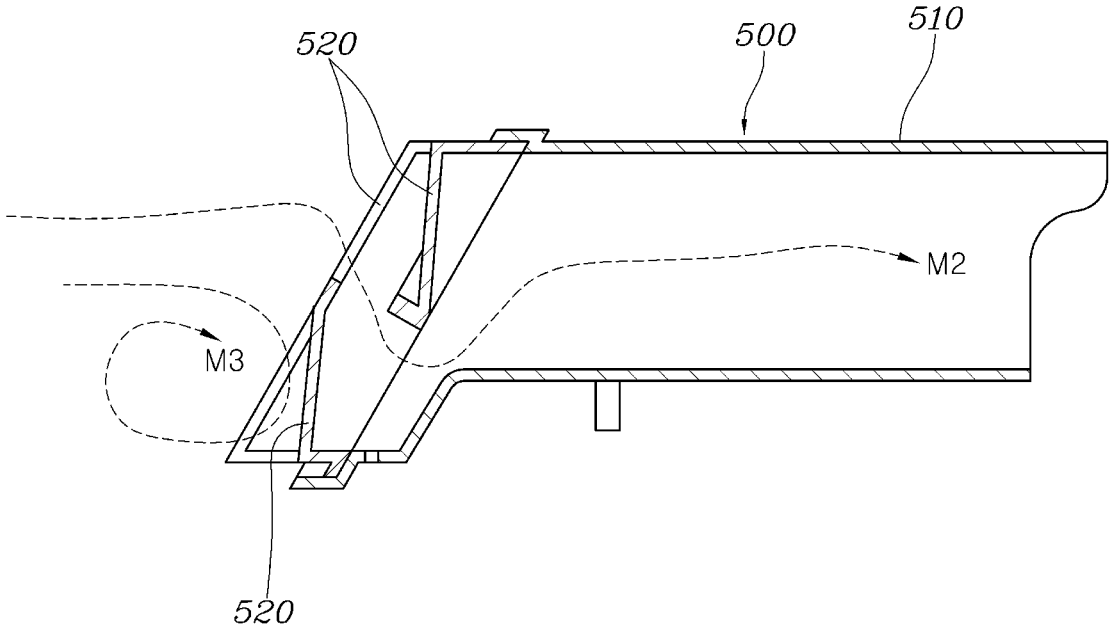
FIG. 5 is a cross-sectional view of FIG. 4.
Figure 6:
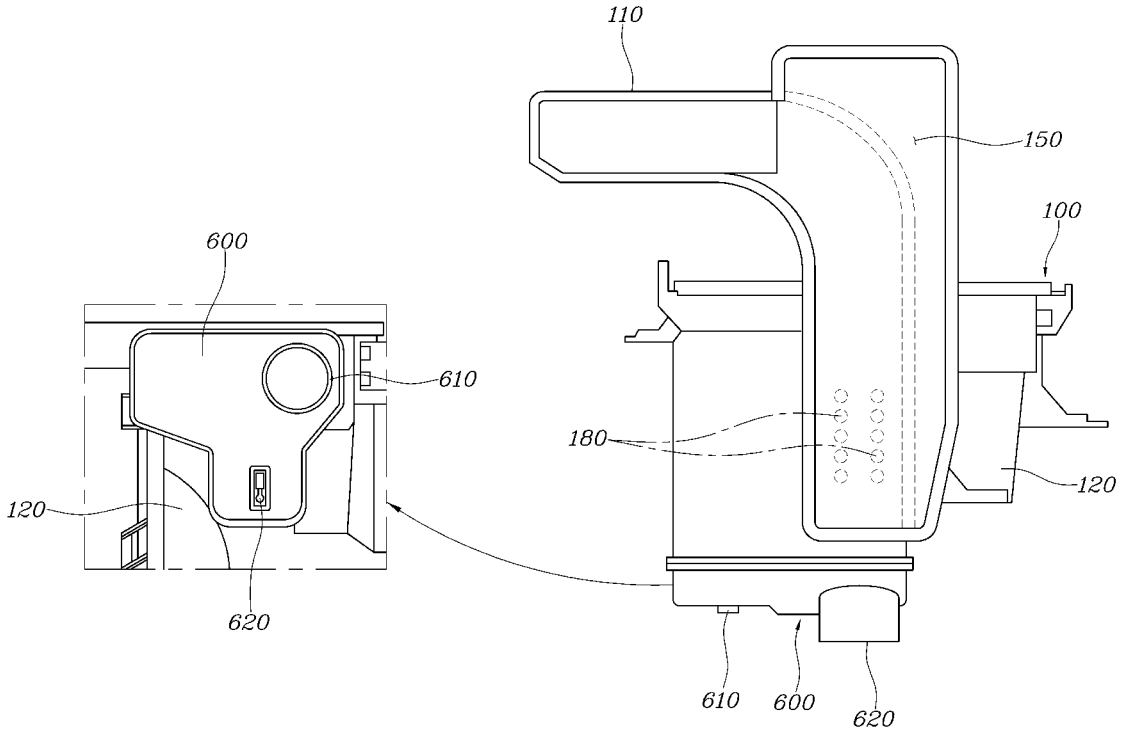
FIG. 6 and FIG. 7 are views exemplarily illustrating an air cleaner body assembly and an air cleaner body lower cap according to an exemplary embodiment of the present disclosure.

As illustrated in FIG. 3, in the intake system according to an exemplary embodiment of the present disclosure, an entrance 111 of the intake duct portion 110 and the filter 200 which is mounted in the air cleaner body portion 120 are positioned above a connection portion 130 that connects the intake duct portion 110 and the air cleaner body portion 120, so that an air movement path from the entrance 111 of the intake duct portion 110 to the filter 200 is configured so that air is moved along a route formed in an arc shape as a path M1 illustrated in a dotted line.

That is, the air movement path from the entrance 111 of the intake duct portion 110 to the filter 200 is a structure in which air is moved along a 'U'-shaped movement path. Therefore, even if water (moisture) is introduced into the intake duct portion 110 together with outside air, water that has been introduced into the intake duct portion 110 is prevented from moving to the filter 200 of the air cleaner body portion 120. Accordingly, damage to the intake system by water (moisture) may be prevented, and damage to an engine may further be maximally prevented.

Therefore, according to an exemplary embodiment of the present disclosure, the intake system including the 'U'-shaped movement path may be used more usefully in a tropical rain forest region, such as Southeast Asia, having a large amount of precipitation. Accordingly, fording ability of the vehicle may be increased.

The intake system according to an exemplary embodiment of the present disclosure further includes an intake shield 500 which is coupled to the entrance 111 of the intake duct portion 110 and which prevents moisture and impurities from being introduced into the intake duct portion 110.

The intake shield 500 includes a casing portion 510 coupled to the intake duct portion 110, and includes a grill portion 520 provided in a front surface of the casing portion 510.

The grill portion 520 has a structure in which a plurality of blocking plates is provided in a diagonal direction thereof. Therefore, as illustrated by an arrow M2 in a dotted line, outside air is moved so that the outside air passes through the grill portion 520 and is introduced into the casing portion 510 and the intake duct portion 110. Furthermore, as illustrated by an arrow M3 in a dotted line, most of impurities and water (moisture) included in the outside air are blocked by the grill portion 520 and are not capable of passing through the grill portion 520, so that a situation in which impurities and water (moisture) are introduced into the casing portion 510 may be maximally prevented.

In more detail, a duct cap 140 may be formed integrally with the entrance 111 of the intake duct portion 110 by being fusion-coupled to the entrance 111 of the intake duct portion 110, and a rear end portion of the casing portion 510 may be coupled to a front surface of the duct cap 140.

According to an exemplary embodiment of the present disclosure, the intake duct portion 110 includes a first internal resonator portion 150 that expands a space by being connected to the intake duct portion 110, and intake noise and engine noise may be reduced by the first internal resonator portion 150.

Furthermore, the air cleaner body portion 120 includes a second internal resonator portion 160 configured for reducing the engine noise, and a filter mounting portion 170 in which the filter 200 is mounted is provided above the second internal resonator portion 160.

According to an exemplary embodiment of the present disclosure, an air cleaner body lower cap 600 is fusion-coupled to a lower end portion of the air cleaner body portion 120, and a first drain valve 610 for discharging moisture and impurities is provided at a bottom portion of the air cleaner body lower cap 600.

Figure 7:
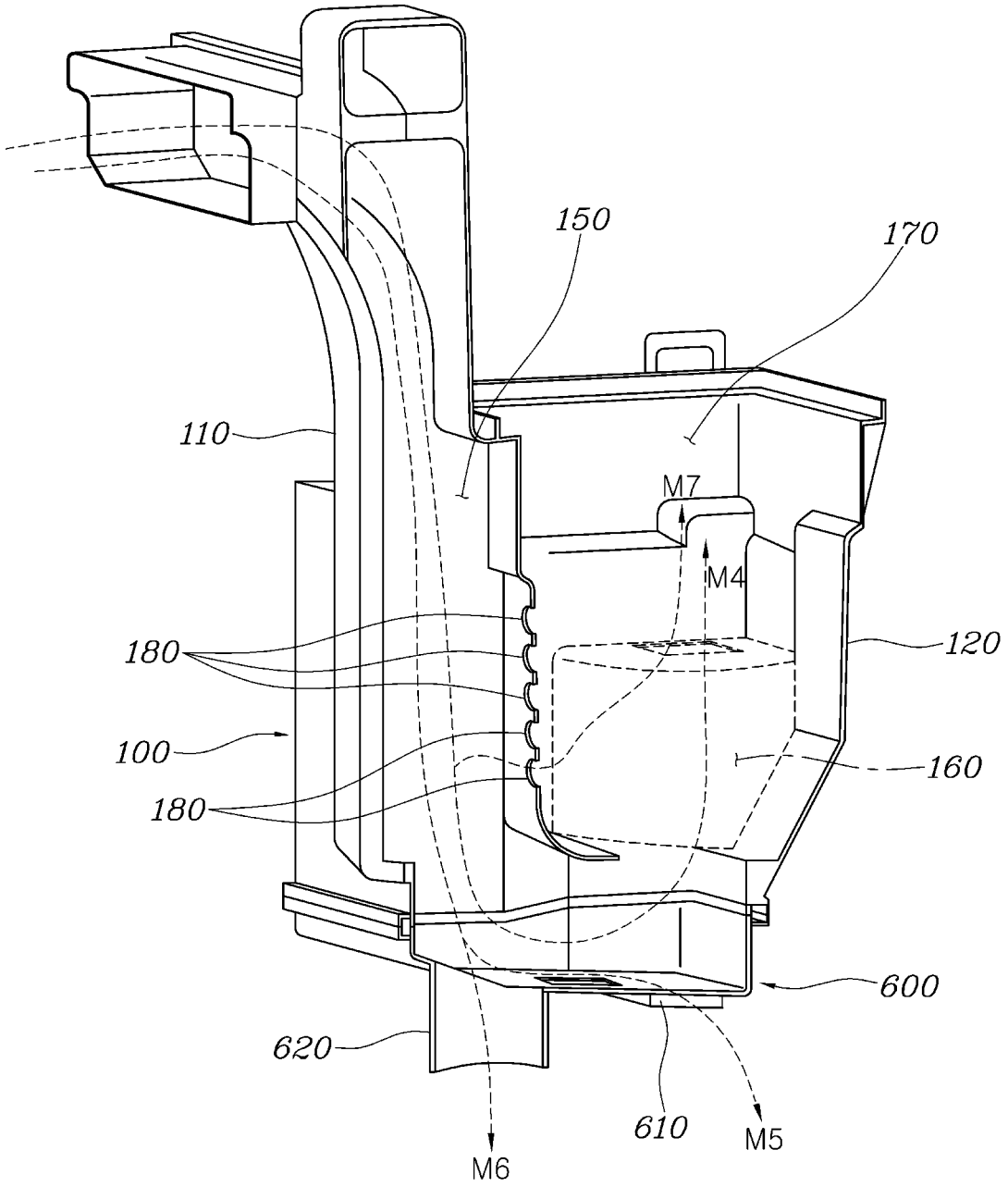
Figure 8:
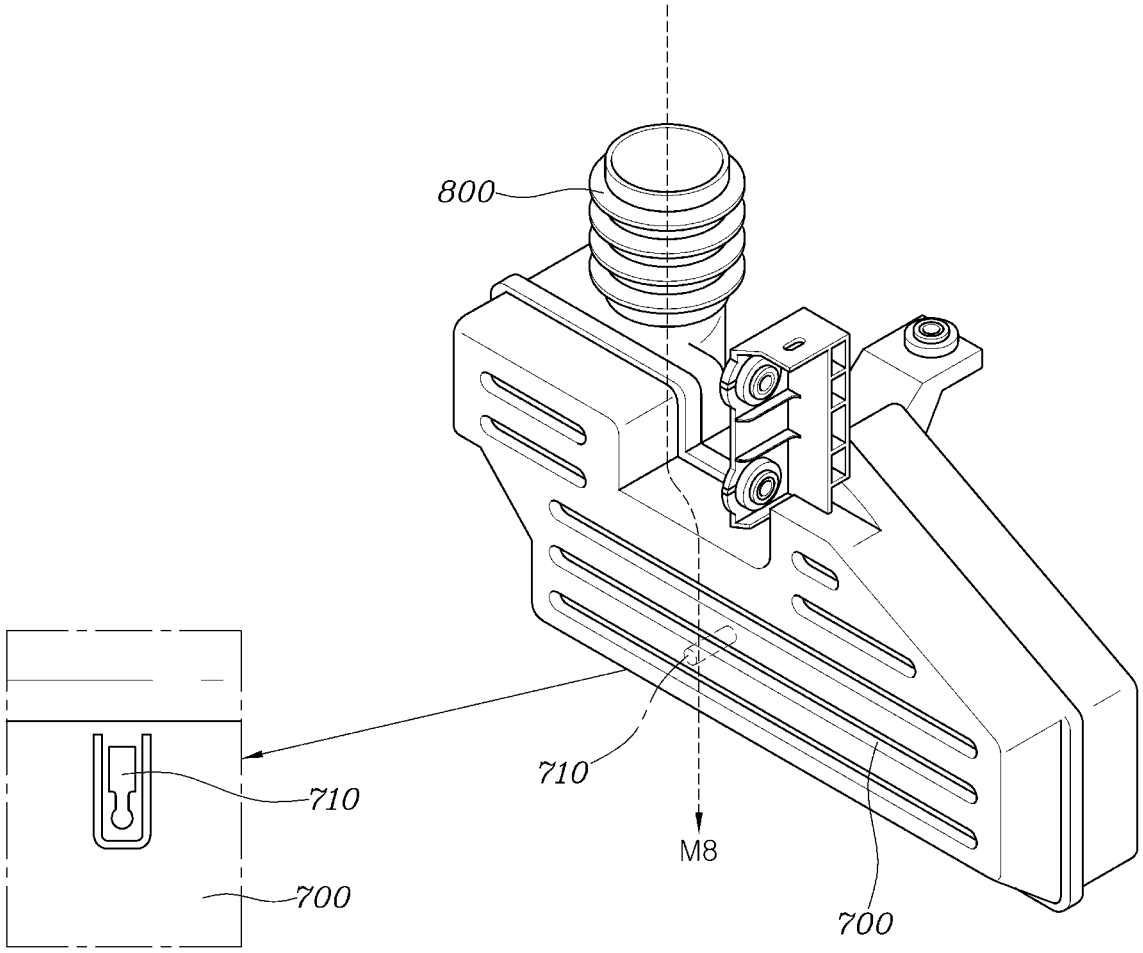
FIG. 8 is a view exemplarily illustrating an external resonator according to an exemplary embodiment of the present disclosure.
Figure 9:
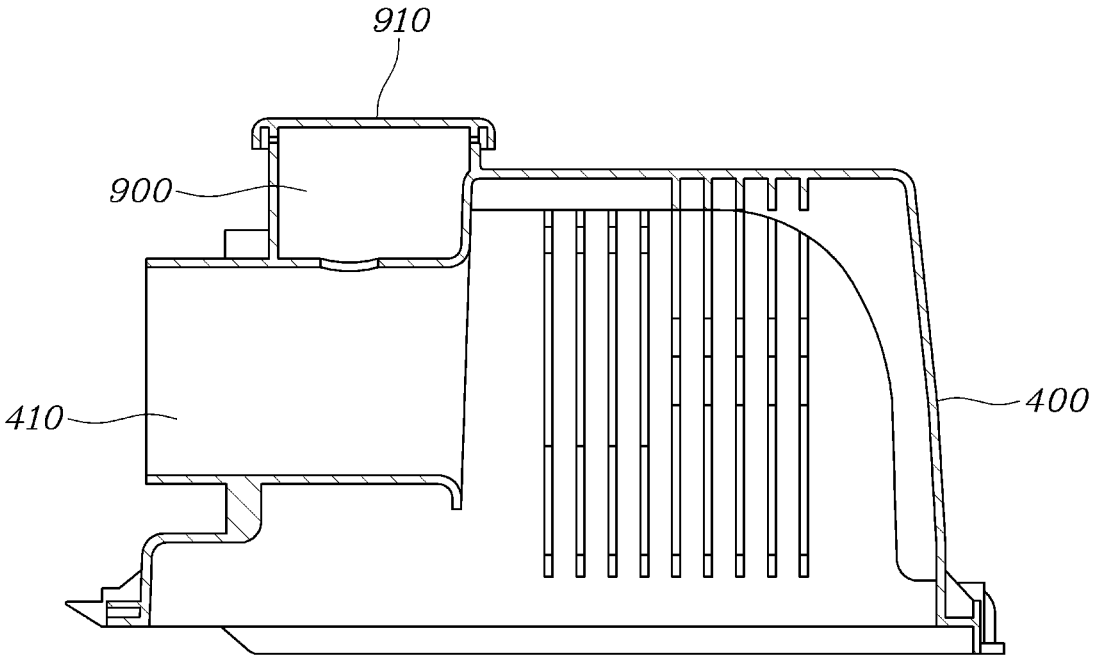
FIG. 9 is a cross-sectional view exemplarily illustrating an air cleaner cover according to an exemplary embodiment of the present disclosure.
Figure 10:
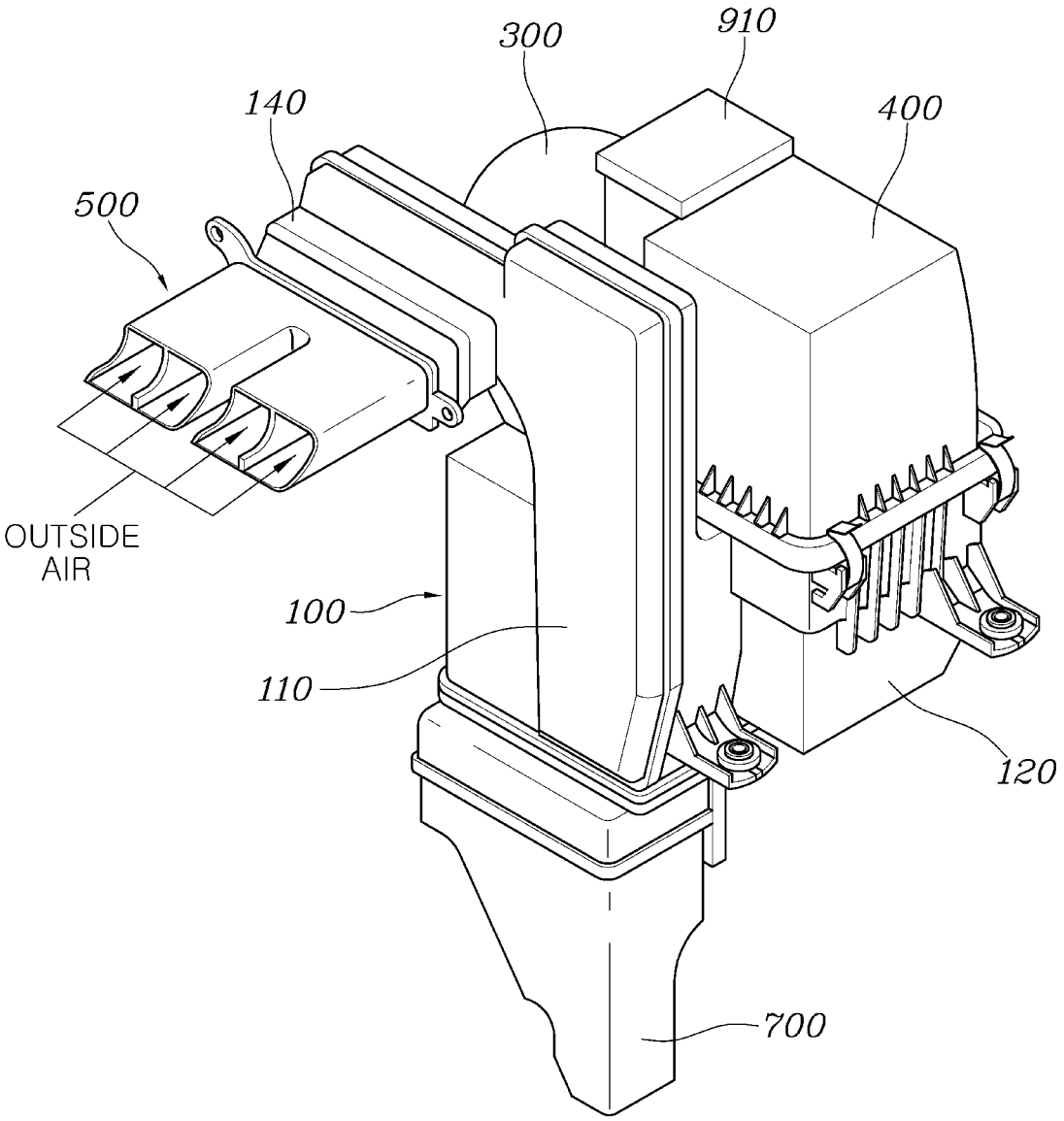
FIG. 10 is the intake system according to various exemplary embodiments of the present disclosure.

As illustrated by an arrow M4 in a dotted line in FIG. 7, air that has been introduced into the intake duct portion 110 is moved downwards along the intake duct portion 110, and then is introduced into the air cleaner body lower cap 600.

Next, the air that has passed through the air cleaner body lower cap 600 is introduced into the second internal resonator portion 160, and then passes through the second internal resonator portion 160. Next, the air is moved upward and is passing through the filter 200, and then is moved to a combustion chamber by passing through the air cleaner cover 400 and the intake hose 300.

Furthermore, as illustrated by an arrow M5 in a dotted line in FIG. 7, impurities and water (moisture) that have been introduced into the intake duct portion 110 together with outside air are moved downwards along the intake duct portion 110. Next, the impurities and the water (moisture) may be discharged outside through the first drain valve 610 provided at the air cleaner body lower cap 600. Otherwise, as illustrated by an arrow M6, the impurities and the water (moisture) may freely fall, through a neck portion 620 provided in the air cleaner body lower cap 600, and move to an external resonator 700 which is to be described later.

The neck portion 620 of the air cleaner body lower cap 600 is a portion to which the external resonator 700 is connected.

Meanwhile, according to an exemplary embodiment of the present disclosure further includes a plurality of connection holes 180 that connects the intake duct portion 110 and the air cleaner body portion 120 from above the air cleaner body lower cap 600.

The plurality of connection holes 180 may be formed so that the plurality of connection holes 180 is connected to the air cleaner body portion 120 from the lower end portion of the intake duct portion 110.

When water flows backward to the air cleaner body lower cap 600 through the first drain valve 610, air introduced into the intake duct portion 110 does not move in the same movement path as the above-mentioned arrow M4 due to the water existing in the air cleaner body lower cap 600.

Therefore, when water flows backward to the air cleaner body lower cap 600 through the first drain valve 610, air introduced into the intake duct portion 110 is moved downwards along the intake duct portion 110 as illustrated by an arrow M7 in a dotted line in FIG. 7, and then is moved to the air cleaner body portion 120 through the plurality of connection holes 180. Next, the air that has moved to the air cleaner body portion 120 does not pass through the second internal resonator portion 160, but moves directly upward and passes through the filter 200. Next, the air is moved to the combustion chamber of the engine by passing through the air cleaner cover 400 and the intake hose 300.

That is, the plurality of connection holes 180 functions as a bypass passage that allows air to smoothly move to the air cleaner body portion 120 from the intake duct portion 110 when water flows backward to the air cleaner body lower cap 600 through the first drain valve 610.

The intake system according to an exemplary embodiment of the present disclosure further includes the external resonator 700 which is connected to the air cleaner body lower cap 600 and which reduces the engine noise.

The external resonator 700 is configured to reduce noise generated from the engine, and has a volume thereof much greater than a volume of the first internal resonator portion 150 and a volume of the second internal resonator portion 160.

The external resonator 700 may be manufactured as a separate component and may be coupled to the air cleaner body lower cap 600. In the present situation, the external resonator 700 has a structure in which the external resonator 700 is connected to the neck portion 620 of the air cleaner body lower cap 600. Furthermore, a rubber seal 800 may be coupled to a portion where the air cleaner body lower cap 600 and the external resonator 700 are connected, i.e., the neck portion 620 of the air cleaner body lower cap 600.

The rubber seal 800 is configured to prevent water (moisture) from entering, and may be formed of a material other than rubber.

According to an exemplary embodiment of the present disclosure, a second drain valve 710 for discharging water and impurities is provided at a bottom portion of the external resonator 700.

As illustrated by the arrow M6 in FIG. 7, impurities and water (moisture) that have been introduced into the intake duct portion 110 together with outside air are moved downwards along the intake duct portion 110. Next, the impurities and the water freely fall and move to the external resonator 700 through the neck portion 620 of the air cleaner body lower cap 600. Next, as illustrated by an arrow M8 in FIG. 8, the impurities and the water that have been introduced into the external resonator 700 may be discharged outside through the second drain valve 710 provided at the external resonator 700.

The external resonator 700 is configured so that the external resonator 700 is connected to a lower portion of the intake duct portion 110. Therefore, when water is introduced into the intake duct portion 110, the water is guided to be moved downwards so that the water is stored in the external resonator 700 or the water is discharged outside through the second drain valve 710.

At the present time, the external resonator 700 simultaneously performs two functions that are a noise reducing function and a water discharging function. That is, during high-speed driving of the vehicle, the external resonator 700 is configured to reduce noise generated from the engine. Otherwise, while driving of the vehicle in a flooded region or in a water transmission pipeline, the fording ability of the vehicle may be increased by discharging water that has been introduced into the intake duct portion 110 to the outside through the second drain valve 710.

According to an exemplary embodiment of the present disclosure, a diffuser 410 connected to the intake hose 300 is formed integrally with the air cleaner cover 400, a third internal resonator 900 is integrally provided at an upper end portion of the diffuser 410, and a resonator cap 910 is fusion-coupled to the air cleaner cover 400 to form a volume of the third internal resonator 900.

Both the diffuser 410 and the third internal resonator 900 are configured to reduce noise. Furthermore, the third internal resonator 900 may be formed integrally with the air cleaner cover 400, or may be separately formed and may be connected to and coupled to the air cleaner cover 400.

As described above, the intake system according to an exemplary embodiment of the present disclosure has a structure in which air moves from the entrance 111 of the intake duct portion 110 into which outside air is introduced to a position where the filter 200 is mounted, along the 'U'-shaped movement path. Therefore, even if water (moisture) is introduced into the intake duct portion 110 together with outside air, water that has been introduced into the intake duct portion 110 may be prevented from moving to the filter 200 of the air cleaner body portion 120. Accordingly, damage to the intake system caused by water (moisture) may be prevented, and damage to the engine may further be maximally prevented.

Furthermore, the intake system of the present disclosure has a configuration in which the intake duct portion 110 into which outside air is introduced and the air cleaner body portion 120 in which the filter 200 is mounted are formed integrally with each other, and has a configuration in which the external resonator 700 is integrally formed at the air cleaner body portion 120 as necessary. Accordingly, a simplified configuration may be realized, and reduction in man-hours and in manufacturing cost may be realized.

Furthermore, the terms such as "unit", "module", etc. disclosed in the specification mean units for processing at least one function or operation, which may be implemented by hardware, software, or a combination thereof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the FIGS.. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. An intake system for a vehicle, the intake system comprising:

an air cleaner body assembly in which an intake duct portion into which air moves and an air cleaner body portion where a filter is mounted are formed integrally with each other; and an air cleaner cover which is detachably coupled to the air cleaner body portion and to which an intake hose is connected, a plurality of connection holes that fluidically connects the intake duct portion and the air cleaner body portion.

2. The intake system of claim 1, wherein an entrance of the intake duct portion and the filter which is mounted in the air cleaner body portion are positioned above a connection portion that connects the intake duct portion and the air cleaner body portion, so that a movement path of the air from the entrance of the intake duct portion to the filter is formed along an arcuate route.

3. The intake system of claim 2, wherein the movement path of the air from the entrance of the intake duct portion to the filter is formed in a shape of "U".

4. The intake system of claim 1, further including:

an intake shield which is coupled to an entrance of the intake duct portion and which is preventing moisture and impurities from being introduced into the intake duct portion, wherein the intake shield includes a casing portion coupled to the intake duct portion, and includes a grill portion provided in a front surface of the casing portion.

5. The intake system of claim 1, wherein the intake duct portion is provided with a first internal resonator portion that is formed to expand a space thereof by being connected to the intake duct portion.

6. The intake system of claim 1, wherein the air cleaner body portion is provided with a second internal resonator portion which is for reducing noise, and a filter mounting portion is provided above the second internal resonator portion.

7. The intake system of claim 6, wherein an air cleaner body lower cap is fusion-coupled to a lower end portion of the air cleaner body portion, and a first drain valve for discharging moisture and impurities is provided at a bottom portion of the air cleaner body lower cap.

8. The intake system of claim 7, wherein the air that has been introduced into the intake duct portion moves downward along the intake duct portion, and then passes through the filter after passing through the air cleaner body lower cap and the second internal resonator portion.

9. The intake system of claim 7, wherein the plurality of connection holes is positioned above the air cleaner body lower cap, and wherein when water flows backward to the air cleaner body lower cap through the first drain valve, the air that has been introduced into the intake duct portion moves downward along the intake duct portion and then moves to the air cleaner body portion through the plurality of connection holes, and then passes through the filter by bypassing the second internal resonator portion.

10. The intake system of claim 7, further including an external resonator which is connected to the air cleaner body lower cap and which reduces engine noise.

11. The intake system of claim 10, wherein the external resonator is manufactured as an individual component, and is coupled to the air cleaner body lower cap.

12. The intake system of claim 10, wherein the external resonator is formed integrally with the air cleaner body lower cap.

13. The intake system of claim 11, wherein when the external resonator is manufactured as the individual component and is coupled to the air cleaner body lower cap, a rubber seal is coupled to a portion to which the air cleaner body lower cap and the external resonator are coupled so that airtightness is maintained therebetween.

14. The intake system of claim 10, wherein a second drain valve for discharging the moisture and the impurities is provided at a bottom portion of the external resonator.

15. The intake system of claim 1, wherein a diffuser connected to the intake hose is formed integrally with the air cleaner cover.

16. The intake system of claim 15, wherein, on the air cleaner cover, a third internal resonator is integrally provided on an upper end portion of the diffuser, and a resonator cap is fusion-coupled to the air cleaner cover to form a volume of the third internal resonator.

* * * * *